US010604826B2

(12) United States Patent
Wang et al.

(10) Patent No.: US 10,604,826 B2
(45) Date of Patent: Mar. 31, 2020

(54) ALUMINUM MICROSTRUCTURE FOR HIGHLY SHAPED PRODUCTS AND ASSOCIATED METHODS

(71) Applicant: Novelis Inc., Atlanta, GA (US)

(72) Inventors: Yi Wang, Kennesaw, GA (US); Wei Wen, Powder Springs, GA (US); Johnson Go, Marietta, GA (US)

(73) Assignee: Novelis Inc., Atlanta, GA (US)

( * ) Notice: Subject to any disclaimer, the term of this patent is extended or adjusted under 35 U.S.C. 154(b) by 894 days.

(21) Appl. No.: 14/972,839

(22) Filed: Dec. 17, 2015

(65) Prior Publication Data

US 2017/0175233 A1 Jun. 22, 2017

(51) Int. Cl.

| | |
|---|---|
| ***C22C 21/18*** | (2006.01) |
| ***B65D 1/12*** | (2006.01) |
| ***C22C 21/00*** | (2006.01) |
| ***C22F 1/04*** | (2006.01) |
| ***B65D 1/02*** | (2006.01) |

(52) U.S. Cl.

CPC ..... *C22C 21/18* (2013.01); *B65D 1/0207* (2013.01); *B65D 1/12* (2013.01); *C22C 21/00* (2013.01); *C22F 1/04* (2013.01)

(58) Field of Classification Search

CPC ..... C22C 21/00; C22C 21/18; B65D 1/0207; B65D 1/12; C22F 1/04

USPC ..... 148/437

See application file for complete search history.

(56) References Cited

U.S. PATENT DOCUMENTS

| | | | |
|---|---|---|---|
| 5,037,707 | A | 8/1991 | Fortin et al. |
| 5,047,707 | A | 9/1991 | Dixon et al. |
| 6,117,252 | A | 9/2000 | Barlat et al. |
| 6,221,182 | B1 | 4/2001 | Barlat et al. |
| 6,342,112 | B1 | 1/2002 | Barlat et al. |
| 6,562,154 | B1 | 5/2003 | Rioja et al. |
| 10,022,773 | B2 | 7/2018 | Rouns et al. |
| 10,161,020 | B2 | 12/2018 | Cheong et al. |

(Continued)

FOREIGN PATENT DOCUMENTS

| | | | |
|---|---|---|---|
| CN | 104988423 | A | 10/2015 |
| JP | 2002105574 | A * | 4/2002 |

(Continued)

OTHER PUBLICATIONS

English language machine translation of JP 2002105574 to Sakuma et al. Generated Oct. 10, 2018. (Year: 2018).*

(Continued)

*Primary Examiner* — Brian D Walck

(74) *Attorney, Agent, or Firm* — Kilpatrick Townsend & Stockton LLP

(57) ABSTRACT

Aluminum and aluminum alloy microstructures that are adapted for improved performance during shaping and forming production processes. Lower relative ratios of alpha fibers, particularly low-end alpha fibers, to beta fibers promotes improved formability of aluminum sheet or blanks without negatively impacting material strength. Beta fibers with higher relative ratios of S and Copper texture components improve formability and produce fewer and more uniform distortions during production. The resulting improvements in quality allow for cupping, drawing, wall ironing, shaping, and necking processes to be carried out faster and with reduced rates of spoilage.

16 Claims, 2 Drawing Sheets

(56) References Cited

U.S. PATENT DOCUMENTS

| | | | |
|---|---|---|---|
| 2007/0266758 | A1 | 11/2007 | Myers et al. |
| 2009/0084474 | A1 | 4/2009 | Cheong et al. |
| 2012/0043294 | A1 | 2/2012 | Dick et al. |
| 2017/0016102 | A1 | 1/2017 | Nakanishi et al. |

FOREIGN PATENT DOCUMENTS

| | | |
|---|---|---|
| JP | 2004250738 | 9/2004 |
| JP | 2016141886 | 8/2016 |
| RU | 2492260 | 9/2013 |
| WO | 2015132932 | 9/2015 |
| WO | 2015140833 A1 | 9/2015 |

OTHER PUBLICATIONS

Korean Application No. 10-2018-7006832 , "Office Action", dated Jun. 27, 2018, 7 pages.
International Application No. PCT/US2016/065083 , "International Preliminary Report on Patentability", dated Jun. 28, 2018, 7 pages.
Australian Patent Application No. 2016354804, Examination Report No. 1 dated Oct. 25, 2017, 3 pages.
International Patent Application No. PCT/US2016/065083, International Search Report and Written Opinion dated Jan. 25, 2018, 13 pages.
Korean Patent Application No. 10-2018-7006832, Office Action dated Mar. 22, 2018, 8 pages.
Wakeel, A., et al., "Development of a strong Goss during annealing of a heavily rolled Al-0.3% Cu alloy," IOP Conference Series: Materials Science and Engineering, 2015, vol. 82, 5 pages, IOP Publishing.
Canadian Patent Application No. 2,994,564, Office Action dated Apr. 13, 2018, 4 pages.
Engler, Olaf, et al., "Simulation of earing profiles from texture data by means of a visco-plastic self-consistent polycrystal plasticity approach," Materials Science and Engineering A, 2004, pp. 350-362, vol. 373, Elsevier B.V.
Engler, Olaf, et al., "Polycrystal-plasticity simulation of six and eight ears in deep-drawn aluminum cups," Materials Science and Engineering A, 2007, pp. 640-651, vol. 452-453, Elsevier B.V.
Engler, Olaf, et al., "Texture-based design of a convoluted cut-edge for earing-free beverage cans," Journal of Materials Processing Technology, 2011, pp. 1278-1284, vol. 211, Elsevier B.V.
Engler, Olaf, et al., "Control of texture and earing in aluminium alloy AA 3105 sheet for packaging applications," Materials Science and Engineering A, 2012, pp. 69-80, vol. 538, Elsevier B.V.
Mondal, Chandan, et al., "Effect of change of rolling planes on orientation rotation around the β-fiber of high-purity aluminum plate subjected to 90% cold pre-deformation," Scripta Materialia, 2012, pp. 674-677, vol. 66, Elsevier Ltd.
International Patent Application No. PCT/US2016/065083, International Search Report and Written Opinion dated Mar. 27, 2017, 10 pages.
Japanese Application No. 2018-516692 , "Office Action", dated Oct. 9, 2018, 5 pages.
Korean Application No. 10-2018-7006832 , "Office Action", dated Aug. 14, 2018, 7 pages.
Engler et al., "Polycrystal—Plasticity Simulation of Six and Eight Ears in Deep-Drawn Aluminum Cups, Matreials Science and Engineering", A, Elsevier, Amsterdam, NL, vol. 452-453, 2007, pp. 640-651.
Russian Application No. 2017121819 , "Office Action", dated Nov. 9, 2018, 7 pages.
Office Action issued in Canadian Application No. 2,994,564 dated Dec. 20, 2018 (5 pages).
Decision of Rejection issued in Japanese Application No. 2018-516692 dated Feb. 26, 2019, along with an English translation (8 pages).
Communication pursuant to Article 94(3) EPC issued in Application No. 16819768.9 dated Apr. 3, 2019 (3 pages).
Mitsuoshi Kuroda, "Effects of Texture on Mechanical Properties of Aluminum Alloy Sheets and Texture Optimization Strategy." CP778 vol. A, Numisheet 2005.
Evgenii et al., "Investigation of texture and structure evolution during hot rolling of 1070, 3104 and 8011 aluminum alloys in continuous mill." La Metallurgia Italiana, n. 3 2017.
Hirsch et al., "Texture Evolution During Rolling of Aluminum Alloys." Light Metals 2008.
Juergen Hirsh, "Texture Evolution and Earing in Aluminum Can Sheet." Materials Science Forum, vols. 495-497, pp. 1565-1572 (2005).
Inoue et al., "Texture Control for Improving Deep Drawability in Rolled and Annealed Aluminum Alloy Sheets." Materials Transactions, vol. 48, No. 8 (2007), pp. 2014-2022.
Wakeel et al., "Development of a Strongg Goss Texture During Annealing of a Heavily Rolled Al-0.3% Cu Alloy," 2015 IOP Conf. Ser.: Mater. Sci. and Eng. 82 012050.
Office Action issued in Chinese Patent Application No. 201680004262.2 dated Jul. 3, 2019, along with an English translation, 29 pages.
Office Action issued in Canadian Patent Application No. 2,994,564 dated Aug. 19, 2019, 4 pages.
Kong et al., "Quantitative Analysis of Texture Evolution in Cross-rolled 3105 Aluminum Alloy", Transactions of Nonferrous Metals Society of China, vol. 19, No. 11, Nov. 15, 2009.
Kong , "Studies on Deformation and Recrystallization Textures of Cross—Rolled 3105 Aluminum Alloy", China Master's Theses Full-text Database (Electronic Periodicals) Engineering Science and Technology, vol. I, No. 8, Aug. 15, 2010, along with an English abstract, 20 pages.
Li , "Relationship Between Earring and Textures in Aluminum Alloy Determined by Diffraction Analyses", Chinese Journal of Stereology and Image Analysis, vol. 11, No. 4, Dec. 30, 2006, 1 page.
Wang , "Textures of Aluminium and Aluminium Alloy Sheet and Strip Materials", Light Alloy Fabrication Technology, vol. 32, No. 6, Jun. 20, 2004, along with machine translation of Abstract.

* cited by examiner

ALUMINUM MICROSTRUCTURE FOR HIGHLY SHAPED PRODUCTS AND ASSOCIATED METHODS

TECHNICAL FIELD

The present application relates to aluminum microstructures and more particularly to aluminum microstructures specifically adapted for highly formed aluminum products and associated methods.

BACKGROUND

Highly shaped aluminum products, including, among others, aluminum cans and/or aluminum bottles for beverages, are manufactured from blanks that are cut from aluminum sheet. Each blank, which is generally circular in shape, is then formed into a cup with a circular base and a vertical wall. During the transition from a relatively two-dimensional circular sheet to a three-dimensional cup, the metal of the blank can become distorted. The resulting waviness around the rim of the cup may be referred to as earing, and the varying thickness of the material around the edge may be referred to as wrinkling. This distortion may become more pronounced as the cup moves through further production processes, such as conventional high speed drawing and wall ironing (DWI), to become a preform.

Earing, wrinkling, and other distortions of the aluminum cup and/or preform, particularly for production of aluminum bottles that require forming a neck, may cause the final highly shaped products to require extra processing steps, trimming of the distorted edges of the cup and/or preform, and may lead to a tendency to fracture the preform. Inconsistent properties of the metal around the circumference of the opening of the cup, preform, and/or neck of a bottle cause increased waste and a reduction in production efficiency by requiring extra trimming and processing steps.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Unless indicated to the contrary, the numerical parameters set forth in the following specification are approximations that can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

Disclosed are microstructure compositions for aluminum and aluminum alloys that facilitate the shaping and forming of aluminum sheet into complex products. Aluminum microstructures with reduced ratios of alpha fibers, particularly low-end alpha fibers, to beta fibers show improved quality and consistency in the production of highly shaped products such as aluminum cans, aluminum bottles, and other containers. The higher proportion of beta fibers improves the formability of the aluminum or aluminum alloy and reduces distortion of the aluminum through the manufacturing process. Similarly, reduced levels of Goss, rotated Goss, and Brass compared to S and Copper texture components also promotes improved runnability and feasibility of high speed manufacturing. The disclosed microstructures may improve efficiency, speed of manufacture, and reduce the spoilage rate for aluminum products that undergo various shaping and forming processes.

BRIEF DESCRIPTION OF THE DRAWINGS

Illustrative examples of the present disclosure are described in detail below with reference to the following drawing figures.

DETAILED DESCRIPTION

Figure 1:
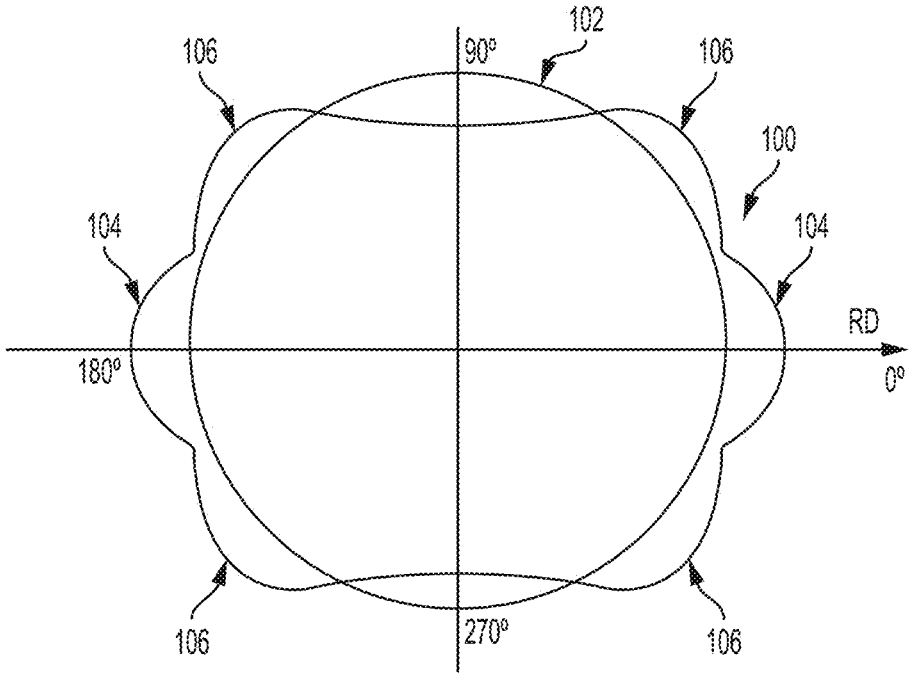
FIG. 1 is a schematic top view of the rim of an aluminum blank after it has been drawn into a cup.

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

As used herein, the terms Goss, rotated Goss, Brass, S, and Copper refer to different texture components of the microstructure of an aluminum alloy. These texture components are known in the art to refer to specific orientations of crystal lattices or polycrystals within the Euler space of the bulk aluminum alloy as described by Bunge's Convention. Under Bunge's Convention, the orientation of a crystal lattice or polycrystal within the Euler space may be described relative to reference axes with three Euler angles ($\varphi_1$, $\Phi$, $\varphi_2$) that represent the following rotations: a first rotation $\varphi_1$ about the Z-axis; a second rotation $\Phi$ about the rotated X-axis; and a third rotation of $\varphi_2$ about the rotated Z-axis. With regards to rolling a metal sheet or plate, the rolling direction (RD) is parallel to the X-axis, the transverse direction (TD) is parallel to the Y-axis, and the normal direction (ND) is parallel to the Z-axis. Each named texture component may be defined by its particular set of Euler angles ($\varphi_1$, $\Phi$, $\varphi_2$) or range of Euler angles ($\varphi_1$, $\Phi$, $\varphi_2$) in the Euler space. The Euler angle and Miller index for Goss, Rotated Goss, Brass, S, and Copper texture components are listed in Table 1.

TABLE 1

| | | Bunge Angle ($\varphi_1$, $\Phi$, $\varphi_2$) | | |
|---|---|---|---|---|
| Name | Index | $\varphi_1$ | $\Phi$ | $\varphi_2$ |
| Goss | {110}<001> | 0 | 45 | 0 |
| Rotated Goss | {110}<16 16 1> | 5 | 45 | 0 |
| Brass | {110}<112> | 35 | 45 | 0 |
| S | {123}<634> | 59 | 37 | 27 |
| Copper | {112}<111> | 90 | 35 | 45 |

Furthermore, the crystal texture of an aluminum alloy may also be characterized by different fibers passing through the bulk material. For example, the crystal texture of the aluminum alloy may be described by an alpha fiber, which may be composed of the Goss, rotated Goss, and Brass texture components. The alpha fiber may be further defined as a low-end alpha fiber, wherein the Euler angle $\varphi_1$ is less than or equal to 15°, or a high-end alpha fiber where the Euler angle $\varphi_1$ falls within the range of 15° to 35°.

Similarly, the combination of Brass, S, and Copper texture components is commonly known as the beta fiber. The relative amounts of the alpha fiber, beta fiber, or any one of their constituent texture components within the bulk material may be expressed as a volume fraction of the material in percent, or as an intensity. Intensity is a dimensionless measure of the relative amount of a texture component compared to a random or uniform distribution of texture components in the microstructure of a bulk material. For example, if a texture component has an intensity value of 1, this indicates that polycrystals of the texture component are found in the bulk material at the same rate as for a bulk material with a random distribution of texture components. A texture component with an intensity value of 3 indicates that polycrystals of the texture component are found in the bulk material three times as often as would be expected for a random or uniform distribution of orientations.

Certain aspects and features of the present disclosure relate to crystallographic textures and/or microstructures of aluminum alloys that are particularly suited to the production of highly shaped products. The crystallographic texture of the aluminum sheet, including the particular volume fractions of the texture components and the ratio of different fibers in the bulk material, influences the formability of the aluminum alloy as it is processed from a blank into a cup, a preform, and/or a finished product. The correct crystallographic texture may provide more uniform deformation of the aluminum sheet as it is deformed from a relatively flat and two-dimensional blank into a three-dimensional cup. Specifically, the uniformity of the material thickness, material properties, and evenness of the cup edge, preform edge, and/or neck opening may be improved by providing metal sheet and the associated blanks having a microstructure that is composed of particular combinations of texture components.

Aluminum or aluminum alloys with a microstructure that has a relatively lower proportion of alpha fibers, and particularly low-end alpha fibers, improves formability in complex and highly formed products. The resulting higher proportion of beta fibers also tends to improve the performance of an aluminum or aluminum alloy blank when it is formed into a cup, preform, and/or finished product. Tailored microstructures may be used with any aluminum or aluminum alloy to improve formability without reducing the strength or otherwise weakening the material. In some cases, especially in the production of aluminum cans or bottles, 3xxx series and/or high recycled content aluminum alloys may benefit from the improved microstructure compositions disclosed herein.

FIG. 1 is a schematic top view of the rim 100 of an aluminum or aluminum alloy cup that has been formed from a circular blank. The rim 100 is overlaid with a normalized height 102 that represents an idealized rim with a uniform height and material thickness (i.e., a rim 100 with no earing) and axes with the rolling direction RD positioned at zero degrees. As shown, the rim 100 has a generally wavy appearance with portions that deviate above or below the normalized height 102. The rim 100 may have relatively large primary ears 104 at the 0° and 180° positions. The rim 100 may also have relatively smaller secondary ears 106 at repeating 45° positions around the circumference of the rim 100. While the illustrated pattern of ears 104, 106 may be typical of most cups formed from circular blanks, other patterns of earing or distortion may be possible.

Because a three-dimensional cup is formed from a relatively two-dimensional blank of aluminum sheet, it is not possible to form a cup with a rim 100 that is at the normalized height 102 at every point around its circumference. Rather, distortions of the metal sheet during formation of the cup cause earing, variations in material thickness, and/or wrinkling of the cup. While these distortions cannot be completely eliminated, they may be reduced or minimized with microstructures that are better suited to the stamping, drawing and wall ironing, necking, and/or other forming processes used in manufacturing highly shaped aluminum products. Aluminum or aluminum alloys with microstructures composed of higher portions of S and Copper texture components with reduced portions of Brass, Goss, and rotated Goss may produce rims 100 with improved uniformity and reduced earing, wrinkling, and/or material variation. Improved rim 100 uniformity may be the result of reducing the magnitude of the primary ears 104, increasing the magnitude of the secondary ears 106, or both.

Figure 2:
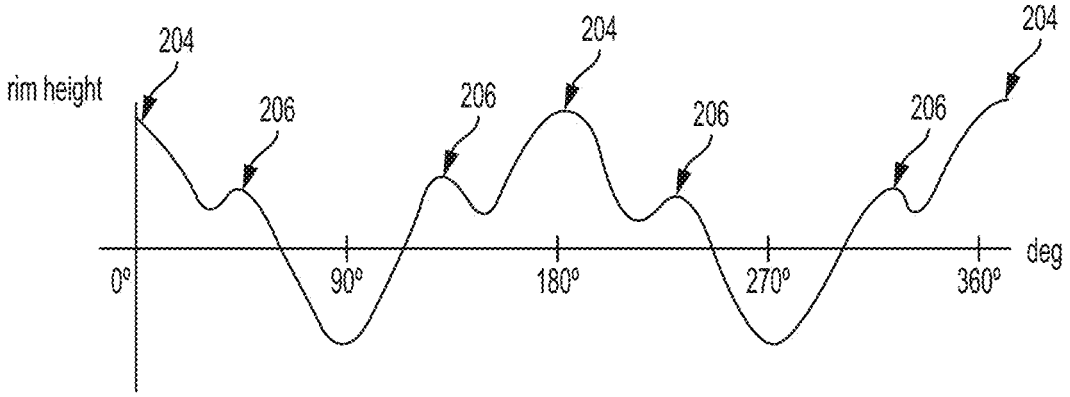
FIG. 2 is a graph showing a generalized earing pattern of a cup drawn from an aluminum blank.

FIG. 2 is a graphical representation of a rim of a cup formed from a circular blank. In this graph, the vertical axis represents deviations from the normalized height of the rim, while the horizontal axis represents the angular position around the rim of the cup. The rim of the cup shows large primary ears 204 at the 0° and 180° positions with smaller secondary ears 206 at repeating 45° positions. Improved microstructure compositions may improve the uniformity of the rim by reducing the magnitude of the primary ears 204, increasing the magnitude of the secondary ears 206, both decreasing the magnitude of the primary ears 204 and increasing the magnitude of the secondary ears 206, and/or improving ear symmetry around the circumference of the rim.

Figure 3A:
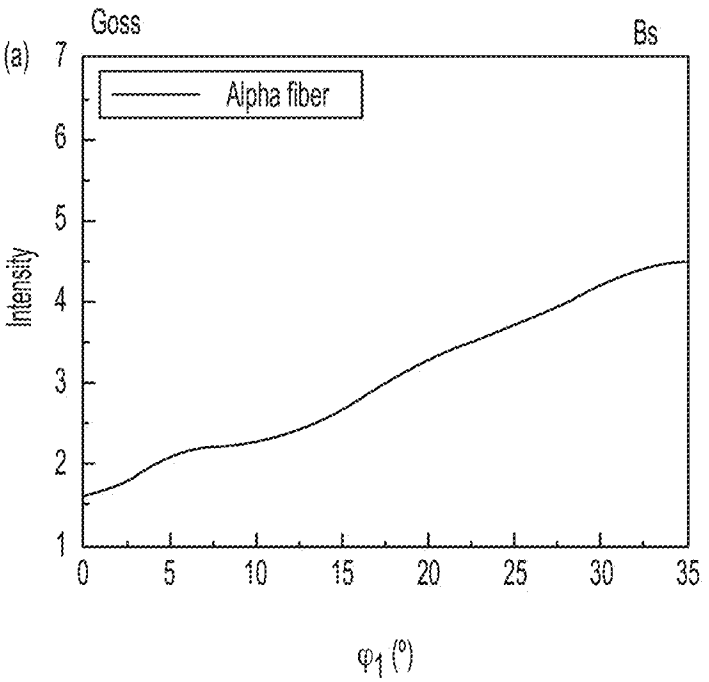
FIG. 3A is graph of the intensity of alpha fibers for an aluminum microstructure with improved forming properties.
Figure 3B:
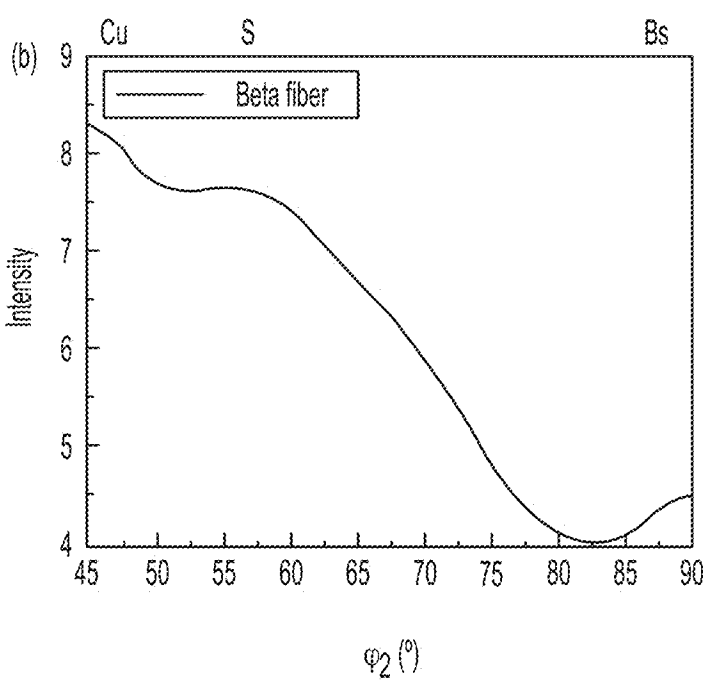
FIG. 3B is a graph of the intensity of beta fibers for an aluminum microstructure with improved forming properties.

FIGS. 3A and 3B show experimental data recording the intensity of texture components in the alpha fiber aligned with varying angles of $\varphi_1$ (FIG. 3A) and the intensity of texture components in the beta fiber aligned with varying angles of $\varphi_2$ (FIG. 3B), respectively, for an aluminum sheet with very improved formability and rim-uniformity. This sheet shows improved resistance to asymmetric and large earing, and improved resistance to cracking or other production defects. FIG. 3A provides intensity data for angles of $\varphi_1$ from 0° to 35° defining the alpha fiber. FIG. 3B provides intensity data for angles of $\varphi_2$ from 45° to 90°, representing the beta fiber. In FIG. 3A, Goss and rotated Goss texture components would be represented on the left hand side of the graph (low values of $\varphi_1$), transitioning to Brass texture components on the right hand side of the graph (higher values of $\varphi_1$). Similarly, in FIG. 3B, Copper texture components would be represented on the left side of the graph (low values of $\varphi_2$), transitioning through S texture components and then to Brass texture components towards the right (high values of $\varphi_2$).

The microstructure and the relative proportions of the individual texture components determines the performance of the metal when it is formed into a cup, preform, and/or finished product. Microstructures that have relatively higher proportions of beta fiber compared to alpha fiber show improved performance. Higher relative amounts of alpha fibers tend to promote large ears at 0° and 180° and high asymmetry of ears between 0° and 90°. By contrast, the beta fiber tends to promote 45° ears and low symmetric earing at 0° and 90°. Trials for forming aluminum cans, bottles, and other highly shaped aluminum products have shown that high 45° ears and lower asymmetric 0° and 180° ears have improved performance during production. These improved formability characteristics give better consistency of production and a lower spoilage rate for highly shaped aluminum products in the cupping, body-making, shaping, and necking stages of manufacture. The resulting improvements in quality, consistency, and efficiency make high speed commercial manufacture more reliable and economically feasible. Notably, as the presence of 0° and 180° ears is reduced and the presence of 45° ears is increased, surface wrinkles and other perturbations that cause instability during high speed deformation are also reduced. The result is lower instability and fewer stress concentrations that may lead to premature failure of the material.

The proper combination of various texture components as described herein may reduce the variation of the Lankford parameter, or R value, from 0° to 90° with respect to the rolling direction (RD) of the metal sheet or plate. This, in turn, may reduce the thickness variation at the top wall and/or the height variation of the cup.

The disclosed microstructures and their relative texture components allow metal to deform more favorably in specific directions under complex strain paths. The microstructure and/or grains of the metal will react differently to stresses which are applied from different directions and/or orientations. For example, elongation may not be the same when the metal grains are deformed in the rolling direction (0°) compared to the transverse direction (90°). This difference in behavior is due to the difference in crystallographic orientation of the grains (i.e. the microtexture). Because the grains are oriented differently throughout the microstructure, different crystallographic slip systems, which may consist of various combinations of slip planes and/or directions, will influence the overall deformation of the metal. In order for the grains to accommodate the strain and/or deformation collectively without a loss in continuity, new dislocations may be generated. These dislocations may only move through the crystal on specific slip plans and in specific directions. When a lower number of slip systems are available, the material's ability to strain will be reduced. Conversely, when a greater number of slip systems are activated, the material's ability to strain will be increased. Thus, by controlling the volume fraction of different texture components, the anisotropic forming behavior of the metal may be optimized for particular processing methods or product shapes. For example, the microstructure of a metal may be optimized to perform favorably in a compressive mode, which is favorable for necking operations (e.g. reductions in diameter) during the production of cans, bottles, or other highly formed articles. In some cases, the microstructure may be optimized to perform favorably in other deformation modes, such as bending, tension, or any other deformation mode as desired or required for a particular application.

The ratio of alpha fiber to beta fiber is directly related to the volume fractions of the texture components. Higher volume fractions of S and Copper texture components, and any texture component between these two, raise the relative intensity of the beta fibers, while relatively lower volume fractions of Goss and rotated Goss may lower the relative intensity of the alpha fibers. In FIG. 3B, the intensity level near the right hand portion of the graph is relatively low for this exemplary microstructure. Testing has shown that lower levels of Brass in the beta fiber significantly improve the performance of the aluminum alloy blanks. Microstructures with a ratio of the intensity of alpha fiber to the intensity of beta fiber at or below approximately 0.15 showed improved performance during cupping and drawing and wall ironing operations, which also improved performance during necking processes. This improved performance may be particularly valuable for producing highly-shaped products, such as aluminum bottles or cans. In some cases, microstructures with a ratio of the intensity of alpha fiber to the intensity of beta fiber at or below approximately 0.10 showed improved cupping and drawing and wall ironing performance, as well as improved performance during necking operations.

The ratio of the intensity of the alpha fiber to the intensity of the beta fiber may be calculated by first finding the area under the intensity curves for the alpha and beta fibers, respectively. In some cases, a simple summation of the collected intensity data will provide adequate information regarding the ratio of the intensity of the alpha fiber to the intensity of the beta fiber. The ratio of the intensities of alpha fiber to beta fiber may be found using the following formulation:

$$\frac{\sum_{i=0}^{i=15} I_{alpha}(i)}{\sum_{i=0}^{i=45} I_{beta}(i)} \leq 0.15$$

where $I_{alpha}(i)$ is the intensity in the Euler space ($\varphi_1$, $\Phi$, $\varphi_2$) for $I_{alpha}(i)=I_{alpha}(i, 45°, 0°)$, i=0, 1, 2, . . . 15 and $I_{beta}(i)$, i=0, 1, 2, . . . 45 is the intensity at Euler space ($\varphi_1$, $\Phi$, $\varphi_2$) listing in Table 2 below.

TABLE 2

| $I_{beta}(i)$ | $\varphi_1$ | $\Phi$ | $\varphi_2$ |
|---|---|---|---|
| $I_{beta}(0)$ | 90.0 | 30.0 | 45.0 |
| $I_{beta}(1)$ | 88.5 | 30.1 | 46.0 |
| $I_{beta}(2)$ | 86.9 | 30.2 | 47.0 |
| $I_{beta}(3)$ | 85.4 | 30.3 | 48.0 |
| $I_{beta}(4)$ | 83.8 | 30.4 | 49.0 |
| $I_{beta}(5)$ | 82.3 | 30.5 | 50.0 |
| $I_{beta}(6)$ | 80.7 | 30.6 | 51.0 |
| $I_{beta}(7)$ | 79.2 | 30.7 | 52.0 |
| $I_{beta}(8)$ | 77.6 | 30.8 | 53.0 |
| $I_{beta}(9)$ | 76.1 | 30.9 | 54.0 |
| $I_{beta}(10)$ | 74.5 | 31.0 | 55.0 |
| $I_{beta}(11)$ | 73.0 | 31.1 | 56.0 |
| $I_{beta}(12)$ | 71.4 | 31.2 | 57.0 |
| $I_{beta}(13)$ | 69.9 | 31.3 | 58.0 |
| $I_{beta}(14)$ | 68.3 | 31.4 | 59.0 |
| $I_{beta}(15)$ | 66.8 | 31.5 | 60.0 |
| $I_{beta}(16)$ | 65.2 | 31.6 | 61.0 |
| $I_{beta}(17)$ | 63.7 | 31.7 | 62.0 |
| $I_{beta}(18)$ | 62.1 | 31.8 | 63.0 |
| $I_{beta}(19)$ | 60.6 | 31.9 | 64.0 |
| $I_{beta}(20)$ | 59.0 | 32.0 | 65.0 |
| $I_{beta}(21)$ | 58.0 | 32.5 | 66.0 |
| $I_{beta}(22)$ | 57.1 | 33.0 | 67.0 |
| $I_{beta}(23)$ | 56.1 | 33.6 | 68.0 |
| $I_{beta}(24)$ | 55.2 | 34.1 | 69.0 |
| $I_{beta}(25)$ | 54.2 | 34.6 | 70.0 |
| $I_{beta}(26)$ | 53.2 | 35.1 | 71.0 |
| $I_{beta}(27)$ | 52.3 | 35.6 | 72.0 |
| $I_{beta}(28)$ | 51.3 | 36.2 | 73.0 |
| $I_{beta}(29)$ | 50.4 | 36.7 | 74.0 |
| $I_{beta}(30)$ | 49.4 | 37.2 | 75.0 |
| $I_{beta}(31)$ | 48.4 | 37.7 | 76.0 |
| $I_{beta}(32)$ | 47.5 | 38.2 | 77.0 |
| $I_{beta}(33)$ | 46.5 | 38.8 | 78.0 |
| $I_{beta}(34)$ | 45.6 | 39.3 | 79.0 |
| $I_{beta}(35)$ | 44.6 | 39.8 | 80.0 |
| $I_{beta}(36)$ | 43.6 | 40.3 | 81.0 |
| $I_{beta}(37)$ | 42.7 | 40.8 | 82.0 |
| $I_{beta}(38)$ | 41.7 | 41.4 | 83.0 |
| $I_{beta}(39)$ | 40.8 | 41.9 | 84.0 |
| $I_{beta}(40)$ | 39.8 | 42.4 | 85.0 |
| $I_{beta}(41)$ | 38.8 | 42.9 | 86.0 |
| $I_{beta}(42)$ | 37.9 | 43.4 | 87.0 |
| $I_{beta}(43)$ | 36.9 | 44.0 | 88.0 |
| $I_{beta}(44)$ | 36.0 | 44.5 | 89.0 |
| $I_{beta}(45)$ | 35.0 | 45.0 | 90.0 |

The performance of the aluminum sheet is also dependent upon the distribution of intensities within the alpha fiber itself. The ratio of the intensity of low-end alpha fiber ($\varphi_1 \leq 15°$) to the intensity of high-end alpha fiber ($15° \leq \varphi_1 \leq 35°$) also impacts formability and performance of the aluminum sheet. As shown in FIG. 3A, the alpha fiber is weighted more heavily towards higher values of $\varphi_1$. During testing, microstructures with a ratio of the intensity of low-end alpha fiber to the intensity of high-end alpha fiber below 0.40 showed improved performance in cupping and drawing and wall ironing production processes. The ratio of the intensities of low-end alpha fiber to high-end alpha fiber may be found using the following formulation:

$$\frac{\sum_{i=0}^{i=15} I_{alpha}(i)}{\sum_{i=15}^{i=35} I_{alpha}(i)} \leq 0.40$$

where $I_{alpha}(i)$ is the intensity in the Euler space ($\varphi_1$, $\Phi$, $\varphi_2$) for $I_{alpha}(i)=I_{alpha}(i, 45°, 0°)$, i=0, 1, 2, . . . 45.

Because of the interrelatedness of the volume fractions of the texture components and the proportions of the alpha and beta fibers, the microstructure of aluminum or an aluminum alloy may be described by the ratio of the intensities of the low-end alpha fibers to the intensities of the high-end alpha fibers and the ratio of the intensities of the alpha fibers to the intensities of the beta fibers, by the volume fractions of the individual texture components, or both. The following examples of microstructures are described using both the ratios of intensities and volume fractions of the texture components. The following examples are provided for illustrative purposes, and are by no means an exhaustive listing.

Manufacturing of aluminum or aluminum alloy sheet or blanks with the following microstructures may be accomplished in any number of ways. For example, a desired microstructure may be achieved through alloying and initial molten metal production techniques, heat treatments, specialized rolling techniques, measurement of the alignment and directionality of the metal microstructure or polycrystals and compensation during production, or any combination thereof. For example, in some cases a specific finishing mill exit temperature may be required to achieve the proper combination of texture components. Furthermore, it may also be necessary to optimize the ratio of hot rolling reduction to cold rolling reduction. In certain cases, achieving the proper combination of texture components may necessitate optimizing the ratio of reduction of individual stands within a hot rolling mill and/or cold rolling mill.

In some cases, the microstructure of the aluminum used in a highly shaped product may have the following texture components as provided in Table 3.

TABLE 3

| Texture Component | Volume Fraction or Ratio |
|---|---|
| Goss or rotated Goss | ≤10% |
| Brass | ≤20% |
| S and Copper | ≥10% |
| Low-End α to High-End α ratio | ≤0.40 |
| Low-End α to β ratio | ≤0.15 |
| Random or Minor orientations | Balance |

In some cases, the microstructure of the aluminum used in a highly shaped product may have the following texture components as provided in Table 4.

TABLE 4

| Texture Component | Volume Fraction or Ratio |
|---|---|
| Goss or rotated Goss | ≤5% |
| Brass | ≤10% |
| S and Copper | ≥15% |
| Low-End α to High-End α ratio | ≤0.40 |
| Low-End α to β ratio | ≤0.15 |
| Random or Minor orientations | Balance |

In certain cases, the microstructure of the aluminum used in a highly shaped product may have the following texture components as provided in Table 5.

TABLE 5

| Texture Component | Volume Fraction or Ratio |
|---|---|
| Goss or rotated Goss | ≤5% |
| Brass | ≤10% |
| S and Copper | ≥15% |

TABLE 5-continued

| Texture Component | Volume Fraction or Ratio |
|---|---|
| Low-End α to High-End α ratio | ≤0.30 |
| Low-End α to β ratio | ≤0.10 |
| Random or Minor orientations | Balance |

In some cases, the aluminum microstructure has a texture of up to about 10% combined Goss and rotated Goss texture components (e.g., from 0% to 5%, from 5% to 10%, from 3% to 7%, etc.) as measured by volume fraction. For example, the microstructure may include 0%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, 4.0%, 4.1%, 4.2%, 4.3%, 4.4%, 4.5%, 4.6%, 4.7%, 4.8%, 4.9%, 5.0%, 5.1%, 5.2%, 5.3%, 5.4%, 5.5%, 5.6%, 5.7%, 5.8%, 5.9%, 6.0%, 6.1%, 6.2%, 6.3%, 6.4%, 6.5%, 6.6%, 6.7%, 6.8%, 6.9%, 7.0%, 7.1%, 7.2%, 7.3%, 7.4%, 7.5%, 7.6%, 7.7%, 7.8%, 7.9%, 8.0%, 8.1%, 8.2%, 8.3%, 8.4%, 8.5%, 8.6%, 8.7%, 8.8%, 8.9%, 9.0%, 9.1%, 9.2%, 9.3%, 9.4%, 9.5%, 9.6%, 9.7%, 9.8%, 9.9%, or 10.0% combined Goss and rotated Goss texture components. All measurements are expressed in volume fraction %.

In some cases, the aluminum microstructure includes a texture of up to about 20% Brass texture components (e.g., from 0% to 10%, from 10% to 15%, or from 15% to 20%, etc.) as measured by volume fraction. For example, the microstructure may include 0%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, 4.0%, 4.1%, 4.2%, 4.3%, 4.4%, 4.5%, 4.6%, 4.7%, 4.8%, 4.9%, 5.0%, 5.1%, 5.2%, 5.3%, 5.4%, 5.5%, 5.6%, 5.7%, 5.8%, 5.9%, 6.0%, 6.1%, 6.2%, 6.3%, 6.4%, 6.5%, 6.6%, 6.7%, 6.8%, 6.9%, 7.0%, 7.1%, 7.2%, 7.3%, 7.4%, 7.5%, 7.6%, 7.7%, 7.8%, 7.9%, 8.0%, 8.1%, 8.2%, 8.3%, 8.4%, 8.5%, 8.6%, 8.7%, 8.8%, 8.9%, 9.0%, 9.1%, 9.2%, 9.3%, 9.4%, 9.5%, 9.6%, 9.7%, 9.8%, 9.9%, 10.0%, 10.1%, 10.2%, 10.3%, 10.4%, 10.5%, 10.6%, 10.7%, 10.8%, 10.9%, 11.0%, 11.1%, 11.2%, 11.3%, 11.4%, 11.5%, 11.6%, 11.7%, 11.8%, 11.9%, 12.0%, 12.1%, 12.2%, 12.3%, 12.4%, 12.5%, 12.6%, 12.7%, 12.8%, 12.9%, 13.0%, 13.1%, 13.2%, 13.3%, 13.4%, 13.5%, 13.6%, 13.7%, 13.8%, 13.9%, 14.0%, 14.1%, 14.2%, 14.3%, 14.4%, 14.5%, 14.6%, 14.7%, 14.8%, 14.9%, 15.0%, 15.1%, 15.2%, 15.3%, 15.4%, 15.5%, 15.6%, 15.7%, 15.8%, 15.9%, 16.0%, 16.1%, 16.2%, 16.3%, 16.4%, 16.5%, 16.6%, 16.7%, 16.8%, 16.9%, 17.0%, 17.1%, 17.2%, 17.3%, 17.4%, 17.5%, 17.6%, 17.7%, 17.8%, 17.9%, 18.0%, 18.1%, 18.2%, 18.3%, 18.4%, 18.5%, 18.6%, 18.7%, 18.8%, 18.9%, 19.0%, 19.1%, 19.2%, 19.3%, 19.4%, 19.5%, 19.6%, 19.7%, 19.8%, 19.9%, or 20.0% Brass texture components. All measurements are expressed in volume fraction %.

In some cases, the aluminum microstructure includes a texture with greater than or equal to about 10% combined S and Copper texture components (e.g., from 10% to 15%, from 15% to 20%, or from 20% to 25%, etc.) as measured by volume fraction. For example, the microstructure may include 10.0%, 10.1%, 10.2%, 10.3%, 10.4%, 10.5%, 10.6%, 10.7%, 10.8%, 10.9%, 11.0%, 11.1%, 11.2%, 11.3%, 11.4%, 11.5%, 11.6%, 11.7%, 11.8%, 11.9%, 12.0%, 12.1%, 12.2%, 12.3%, 12.4%, 12.5%, 12.6%, 12.7%, 12.8%, 12.9%, 13.0%, 13.1%, 13.2%, 13.3%, 13.4%, 13.5%, 13.6%, 13.7%, 13.8%, 13.9%, 14.0%, 14.1%, 14.2%, 14.3%, 14.4%, 14.5%, 14.6%, 14.7%, 14.8%, 14.9%, 15.0%, 15.1%, 15.2%, 15.3%, 15.4%, 15.5%, 15.6%, 15.7%, 15.8%, 15.9%, 16.0%, 16.1%, 16.2%, 16.3%, 16.4%, 16.5%, 16.6%, 16.7%, 16.8%, 16.9%, 17.0%, 17.1%, 17.2%, 17.3%, 17.4%, 17.5%, 17.6%, 17.7%, 17.8%, 17.9%, 18.0%, 18.1%, 18.2%, 18.3%, 18.4%, 18.5%, 18.6%, 18.7%, 18.8%, 18.9%, 19.0%, 19.1%, 19.2%, 19.3%, 19.4%, 19.5%, 19.6%, 19.7%, 19.8%, 19.9%, 20.0%, 20.1%, 20.2%, 20.3%, 20.4%, 20.5%, 20.6%, 20.7%, 20.8%, 20.9%, 21.0%, 21.1%, 21.2%, 21.3%, 21.4%, 21.5%, 21.6%, 21.7%, 21.8%, 21.9%, 22.0%, 22.1%, 22.2%, 22.3%, 22.4%, 22.5%, 22.6%, 22.7%, 22.8%, 22.9%, 23.0%, 23.1%, 23.2%, 23.3%, 23.4%, 23.5%, 23.6%, 23.7%, 23.8%, 23.9%, 24.0%, 24.1%, 24.2%, 24.3%, 24.4%, 24.5%, 24.6%, 24.7%, 24.8%, 24.9%, 25.0%, or more combined S and Copper texture components. All measurements are expressed in volume fraction %.

In certain cases, the aluminum microstructure may include a texture with a ratio of the intensity of low-end alpha fibers to the intensity of high-end alpha fibers below about 0.40 (e.g., from 0.30 to 0.40, from 0.25 to 0.30, or from 0.20 to 0.25, etc.) as measured by the ratio of the two intensities. For example, the microstructure may have a ratio of the intensity of low-end alpha fibers to the intensity of high-end alpha fibers of about 0.00, 0.01, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, or 0.40. All ratios are expressed in a dimensionless ratio of the intensity of low-end alpha fiber to the intensity of high-end alpha fiber.

In some cases, the aluminum microstructure may include a texture with a ratio of the intensity of low-end alpha fibers to the intensity of beta fibers below about 0.15 (e.g., from 0.10 to 0.15, from 0.05 to 0.10, or from 0.01 to 0.05, etc.) as measured by the ratio of the two intensities. For example, the microstructure may have a ratio of the intensity of low-end alpha fibers to the intensity of beta fibers of about 0.00, 0.01, 0.02, 0.03, 0.04, 0.05, 0.06, 0.07, 0.08, 0.09, 0.10, 0.11, 0.12, 0.13, 0.14, or 0.15. All ratios are expressed in a dimensionless ratio of the intensity of low-end alpha fiber to the intensity of beta fiber.

In certain cases, the aluminum microstructure may have the following microstructure composition: ≤10% by volume combined Goss and rotated Goss texture components, ≤20% by volume Brass texture components, ≥10% by volume combined S and Copper texture components, with a ratio of the intensity of low-end alpha fiber to the intensity of high-end alpha fiber of ≤0.40, and a ratio of the intensity of low-end alpha fiber to the intensity of beta fiber of ≤0.15.

In some cases, the aluminum microstructure may have the following microstructure composition: ≤10% by volume combined Goss and rotated Goss texture components, ≤20% by volume Brass texture components, ≥10% by volume combined S and Copper texture components, with a ratio of the intensity of low-end alpha fiber to the intensity of high-end alpha fiber of ≤0.30, and a ratio of the intensity of low-end alpha fiber to the intensity of beta fiber of ≤0.10.

In certain cases, the aluminum microstructure may have the following microstructure composition: ≤5% by volume combined Goss and rotated Goss texture components, ≤10% by volume Brass texture components, ≥15% by volume combined S and Copper texture components, with a ratio of the intensity of low-end alpha fiber to the intensity of high-end alpha fiber of ≤0.40, and a ratio of the intensity of low-end alpha fiber to the intensity of beta fiber of ≤0.15.

In some cases, the aluminum microstructure may have the following microstructure composition: ≤5% by volume combined Goss and rotated Goss texture components, ≤10% by volume Brass texture components, ≥15% by volume combined S and Copper texture components, with a ratio of the intensity of low-end alpha fiber to the intensity of high-end alpha fiber of ≤0.30, and a ratio of the intensity of low-end alpha fiber to the intensity of beta fiber of ≤0.10.

In certain cases, the aluminum microstructure may have the following microstructure composition: ≤7.5% by volume combined Goss and rotated Goss texture components, ≤15% by volume Brass texture components, ≥12.5% by volume combined S and Copper texture components, with a ratio of the intensity of low-end alpha fiber to the intensity of high-end alpha fiber of ≤0.40, and a ratio of the intensity of low-end alpha fiber to the intensity of beta fiber of ≤0.15.

In certain cases, the aluminum microstructure may have the following microstructure composition: ≤7.5% by volume combined Goss and rotated Goss texture components, ≤15% by volume Brass texture components, ≥12.5% by volume combined S and Copper texture components, with a ratio of the intensity of low-end alpha fiber to the intensity of high-end alpha fiber of ≤0.30, and a ratio of the intensity of low-end alpha fiber to the intensity of beta fiber of ≤0.10.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A 3xxx series aluminum alloy having an aluminum microstructure comprising:

from about 0.1% to about 10% by volume of combined Goss and rotated Goss texture components;

from 15% to about 20% by volume of Brass texture components;

greater than or equal to about 10% by volume of combined S and Copper texture components;

a ratio of an intensity of low-end alpha fibers to an intensity of high-end alpha fibers from about 0.01 to about 0.40; and a ratio of the intensity of low-end alpha fibers to an intensity of beta fibers from about 0.01 to about 0.15, with a remainder of the aluminum microstructure in random or minor orientations;

wherein the low-end alpha fibers have a Euler angle $\varphi_1$ of less than 15° and the high-end alpha fibers have a Euler angle $\varphi_1$ from 15 to 35°.

2. The 3xxx series aluminum alloy of claim 1, comprising from about 0.1% to about 5% by volume of combined Goss and rotated Goss texture components.

3. The 3xxx series aluminum alloy of claim 1, comprising greater than or equal to about 15% by volume of combined S and Copper texture components.

4. The 3xxx series aluminum alloy of claim 1, wherein the ratio of the intensity of low-end alpha fibers to the intensity of high-end alpha fibers is from about 0.01 to about 0.30.

5. The 3xxx series aluminum alloy of claim 1, wherein the ratio of the intensity of low-end alpha fibers to the intensity of beta fibers is from about 0.01 to about 0.10.

6. The 3xxx series aluminum alloy of claim 1, comprising from about 0.1% to about 5% by volume of combined Goss and rotated Goss texture components and greater than or equal to about 15% by volume of combined S and Copper texture components.

7. The 3xxx series aluminum alloy of claim 1, comprising:

from about 0.1% to about 5% by volume of combined Goss and rotated Goss texture components;

greater than or equal to about 15% by volume of combined S and Copper texture components, wherein the ratio of the intensity of low-end alpha fibers to the intensity of high-end alpha fibers is from about 0.01 to about 0.30, and the ratio of the intensity of low-end alpha fibers to the intensity of beta fibers is from about 0.01 to about 0.10.

8. A 3xxx series aluminum alloy having an aluminum microstructure comprising from 15% to about 20% by volume of Brass texture components and a ratio of an intensity of low-end alpha fibers to an intensity of high-end alpha fibers of from about 0.01 to about 0.40 and a ratio of the intensity of low-end alpha fibers to an intensity of beta fibers of from about 0.01 to about 0.15; wherein the low-end alpha fibers have a Euler angle $\varphi_1$ of less than 15° and the high-end alpha fibers have a Euler angle $\varphi_1$ from 15 to 35°.

9. The 3xxx series aluminum alloy of claim 8, further comprising from about 0.1% to about 10% by volume of combined Goss and rotated Goss texture components.

10. The 3xxx series aluminum alloy of claim 8, further comprising greater than or equal to about 10% by volume of combined S and Copper texture components.

11. The 3xxx series aluminum alloy of claim 8, wherein the ratio of the intensity of low-end alpha fibers to the intensity of high-end alpha fibers is from about 0.01 to about 0.30 and the ratio of the intensity of low-end alpha fibers to the intensity of beta fibers is from about 0.01 to about 0.10.

12. An aluminum product comprising a microstructure of from about 0.1% to about 10% by volume of combined Goss and rotated Goss texture components, from 15% to about 20% by volume of Brass texture components, greater than or equal to about 10% by volume of combined S and Copper texture components, a ratio of an intensity of low-end alpha fibers to an intensity of high-end alpha fibers of from about 0.01 to about 0.40, and a ratio of the intensity of low-end alpha fibers to an intensity of beta fibers of from about 0.01 to about 0.15, with a remainder of the microstructure comprising random or minor orientations;

wherein the low-end alpha fibers have a Euler angle $\varphi_1$ of less than 15° and the high-end alpha fibers have a Euler angle $\varphi_1$ from 15 to 35°.

13. The aluminum product of claim 12, wherein the aluminum product is a can or a bottle.

14. The aluminum product of claim 12, wherein the microstructure comprises from about 0.1% to about 5% by volume of combined Goss and rotated Goss texture components, and greater than or equal to about 15% by volume of combined S and Copper texture components.

15. The aluminum product of claim 14, wherein the aluminum product is a can or a bottle.

16. The aluminum product of claim 15, wherein the ratio of the intensity of low-end alpha fibers to the intensity of high-end alpha fibers is from about 0.01 to about 0.30, and the ratio of the intensity of low-end alpha fibers to the intensity of beta fibers is from about 0.01 to about 0.10.

* * * * *